US012449218B2

(12) United States Patent
Obed

(10) Patent No.: US 12,449,218 B2
(45) Date of Patent: Oct. 21, 2025

(54) ADJUSTABLE TRIGGER SAFETY SYSTEM

(71) Applicant: Ahmed Obed, Camarillo, CA (US)

(72) Inventor: Ahmed Obed, Camarillo, CA (US)

( * ) Notice: Subject to any disclaimer, the term of this patent is extended or adjusted under 35 U.S.C. 154(b) by 2 days.

(21) Appl. No.: 18/687,290

(22) PCT Filed: Aug. 26, 2022

(86) PCT No.: PCT/US2022/041760

§ 371 (c)(1),
(2) Date: Feb. 27, 2024

(87) PCT Pub. No.: WO2023/028351

PCT Pub. Date: Mar. 2, 2023

(65) Prior Publication Data

US 2025/0035395 A1 Jan. 30, 2025

Related U.S. Application Data

(60) Provisional application No. 63/306,417, filed on Feb. 3, 2022, provisional application No. 63/260,668, filed on Aug. 27, 2021.

(51) Int. Cl.
*F41A 17/46* (2006.01)

(52) U.S. Cl.
CPC ..... *F41A 17/46* (2013.01)

(58) Field of Classification Search
CPC ..... F41A 17/46
See application file for complete search history.

(56) References Cited

U.S. PATENT DOCUMENTS

| | | | | |
|---|---|---|---|---|
| 1,027,583 | A | 5/1912 | Bayer | |
| 1,391,499 | A | 9/1921 | Peterson | |
| 1,410,267 | A | 3/1922 | Peterson | |
| 1,410,270 | A | 3/1922 | Peterson | |
| 1,503,568 | A * | 8/1924 | Walther | F41A 17/20 89/148 |
| 1,593,981 | A | 7/1926 | McCrudden | |
| 2,249,232 | A | 7/1941 | Smith | |
| 2,978,826 | A | 4/1961 | Ivy | |
| 3,964,366 | A * | 6/1976 | Atchisson | F41A 17/28 124/40 |
| 5,036,612 | A | 8/1991 | Jennings | |

(Continued)

*Primary Examiner* — Michelle Clement
(74) *Attorney, Agent, or Firm* — Aileen Shepherd Kell; Joseph C. Harkins

(57) ABSTRACT

An adjustable trigger safety system that replaces a handle or grip of a firearm is disclosed. The adjustable trigger safety system can have a frame that mounts to a portion of a firearm. A finger actuator is used to reposition an indicator that allows the main safety to rotate from a "safe" position to a "fire" position. The lower grip can have an accessory connector to connect external devices. The frame can house and provide pivot points for components located internally or partially internally to the frame, including a safety lever, an activation lever, and a safety cable. Rotation of the activation lever causes the main safety to rotate. The amount of pressure needed to move the safety and activation levers and deactivate the system is adjustable. The safety lever must be depressed before the activation lever, or the activation lever cannot be depressed. The finger actuator is ambidextrous.

12 Claims, 12 Drawing Sheets

(56) References Cited

U.S. PATENT DOCUMENTS

| | | | | |
|---|---|---|---|---|
| 5,517,780 | A * | 5/1996 | Haber | F41A 17/20 42/70.08 |
| 9,291,416 | B2 * | 3/2016 | Würkner | F41A 17/22 |
| 9,341,424 | B2 | 5/2016 | Allen | |
| 9,441,896 | B2 | 9/2016 | Allen | |
| 9,581,401 | B2 | 2/2017 | Faxon | |
| 10,234,225 | B2 * | 3/2019 | Zukowski | F41A 17/20 |
| 10,731,938 | B2 * | 8/2020 | Alicea, Jr. | F41A 3/66 |
| 11,243,035 | B1 * | 2/2022 | Zung | F41A 17/52 |
| 11,698,236 | B2 * | 7/2023 | Zung | F41A 17/22 42/70.11 |
| 2008/0222935 | A1 * | 9/2008 | Christiansen | F41A 17/22 42/70.06 |
| 2017/0299302 | A1 | 10/2017 | Andrei et al. | |
| 2025/0035395 | A1 * | 1/2025 | Obed | F41A 17/22 |

* cited by examiner

ADJUSTABLE TRIGGER SAFETY SYSTEM

CROSS-REFERENCE TO RELATED APPLICATIONS

This application claims the benefit of Provisional Patent Application Ser. No. 63/260,668 filed on Aug. 27, 2021, Provisional Patent Application Ser. No. 63/306,417 filed on Feb. 3, 2022, and PCT Application Serial No. US22/41760 filed on Aug. 26, 2022, by the present inventor. The entire contents of the aforementioned applications are incorporated herein by reference.

BACKGROUND OF THE INVENTION

The fire lance, a bamboo tube that used gunpowder to fire a lance, is considered to be the first gun. It was invented in China in the tenth century. Its first use in battle most likely involved unintended discharges that resulted in injury or death to the operators of the weapon. Since that time, weapon designers and manufacturers have endeavored to prevent their creations from experiencing unintended discharges.

In modern designs, many different safety designs have been employed in guns, with many achieving high levels of protection against unintended discharges. Most safeties operate to prevent the trigger from moving or to otherwise break the firing chain so the weapon cannot be discharged. However, even with the use of safeties, there are still many deaths each year from unintended discharges related to improper weapon handling. Very few guns have an indicator that indicates when the gun is loaded and ready to fire. If a weapon is loaded and the safety is in the "fire" position, a user may not know the condition of the weapon, then attempt to pick up the weapon and unintentionally depress the trigger, thereby causing the weapon to discharge. Sometimes a user may pick up the weapon by grabbing around the center mass resulting in a portion of user's hand other than the index finger depressing the trigger. If a person just happens to be in the line of fire, which could be hundreds of feet away, an injury or death is the typical result. This type of handling of a weapon is a major contributor to the cause of unintended discharges and the injuries that may result.

Many accidental deaths also result when a user is not properly holding the grip of a firearm and unintentionally depresses the trigger. This can happen when a user shifts his/her grip during use, or, is picking up or putting down the weapon and some part of the user's hand unintentionally depresses the trigger.

Current safety systems may require internal modifications to the firearm, fail to promote proper hand grip, lack adaptability to a wide variety of firearms, or are not customizable to the user. As such, there is a demand for improved trigger safety systems to prevent unintentional discharges that is light in weight, adjustable for a user's comfort, indicates when the trigger safety system is disengaged, provides an electrical interface for external devices, and can be adapted to any firearm that utilizes a hollow grip or handle.

SUMMARY

The present invention is directed toward an adjustable trigger safety system. In some embodiments, the adjustable trigger safety system includes a frame, a safety lever, an activation lever, and a main safety. In various embodiments, the frame is configured to mount to a firearm. In other embodiments, the frame can be mounted proximate to a trigger. In additional embodiments, the safety lever and the activation lever partially extend from the frame. In further embodiments, the main safety can move between a first position or "Safe" position and a second position or "Fire" position. In more embodiments, the safety lever must be depressed before the activation lever can be depressed. Additionally, when the activation lever is depressed, it causes the main safety to rotate from the first position to the second position.

In some embodiments, the safety lever has a first safety catch and the activation lever has a second safety catch corresponding to the first safety catch. In other embodiments, the first safety catch will intersect with the second safety catch if the safety lever is not at least partially depressed before the activation lever is depressed. In additional embodiments, the activation lever cannot be depressed if the first safety catch intersects with the second safety catch.

In other embodiments, one end of a safety cable is anchored inside the frame, and the other end of the safety cable is attached to the main safety. In additional embodiments, when depressed, the activation lever comes into contact with and applies a force to the safety cable. In more embodiments, the safety cable will transfer the force to the main safety causing it to move from the first position to the second position.

In some embodiments, a cable catch is located on the activation lever and is configured to come into contact with and apply a force to the safety cable when the activation lever is depressed.

In other embodiments, a locking hole is located on the safety lever and is configured to receive a locking device, where the locking device will prevent the safety lever from being depressed.

In additional embodiments, the adjustable trigger safety system can have an accessory connector that can connect to a device and an accessory activator that can activate the device. In other embodiments, the device can be located external to the frame. In additional embodiments, the accessory activator is integral to the safety lever and will activate the device when the safety lever is depressed. In more embodiments, the safety lever must be fully depressed to activate the device.

In further embodiments, the activation lever can cause the main safety to return to the first position when the activation lever is released and returns to its original position.

The present invention is also directed to an adjustable trigger safety system that includes a firearm having a main safety, a finger actuator, and a trigger safety indicator. In some embodiments, the trigger safety indicator is located coaxially with the main safety. In other embodiments, the trigger safety indicator is mechanically connected to the main safety. In additional embodiments, when the finger actuator is actuated, the trigger safety indicator disconnects from the main safety such that the trigger safety indicator can rotate independently from the main safety.

In other embodiments, when the finger actuator is actuated, the trigger safety indicator disconnects from the main safety and rotates from a first position to a second position.

In further embodiments, the main safety can have a main safety gear and the trigger safety indicator can have a trigger safety gear. In some embodiments, the main safety gear and the trigger safety gear are mechanically engaged such that when the main safety moves, the trigger safety indicator also moves.

In some embodiments, when the finger actuator is actuated, the trigger safety gear disengages from the main safety gear thereby allowing the trigger safety indicator to move independently from the main safety.

In additional embodiments, the finger actuator is ambidextrous.

In other embodiments, the adjustable trigger safety system further comprises a finger actuator lever. In some embodiments, the finger actuator is configured to disconnect the trigger safety indicator from the main safety when the finger actuator is actuated.

In further embodiments, the finger actuator lever is configured to limit the movement of the trigger safety indicator. In other embodiments, when the trigger safety indicator is in the first position and the finger actuator is not actuated, the finger actuator lever prevents the trigger safety indicator and main safety from moving thereby keeping the main safety in the "Safe" position and preventing the firearm from discharging.

In additional embodiments, when the finger actuator is actuated while the trigger indicator is in the first position, the trigger safety indicator moves from the first position to the second position independent of the main safety. In other embodiments, the finger actuator lever allows the trigger safety indicator and the main safety to move concurrently such that the trigger safety indicator returns to the first position and the main safety moves from a "Safe" position to a "Fire" position.

The present invention is further directed toward an adjustable trigger safety system comprising a firearm having a main safety and a grip, an activation lever, a trigger safety indicator, and a finger actuator. In some embodiments, the activation lever is located partially in the grip and is configured to cause the main safety to move from a safe position to a fire position. In other embodiments, the trigger safety indicator mechanically engages with the main safety. In additional embodiments, the trigger safety indicator is capable of rotating from a first position to a second position independent of the main safety. In more embodiments, the finger actuator is configured to mechanically disengage the trigger safety indicator from the main safety. In some embodiments, the finger actuator must be actuated so that the trigger safety indicator rotates to the second position when the main safety stays in the safe position before the activation lever can be depressed causing the main safety to move from the safe position to the fire position.

In some embodiments, the trigger safety indicator automatically moves from the first position to the second position when the finger actuator is actuated.

In other embodiments, when the activation lever is released, the main safety returns to the safe position.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Those of ordinary skill in the art will realize that the following detailed description of the adjustable trigger safety system is illustrative only and is not intended to be in any way limiting. Other embodiments of the adjustable trigger safety system will readily suggest themselves to such skilled persons having the benefit of this disclosure. Reference will now be made in detail to implementations of the adjustable trigger safety system as illustrated in the accompanying drawings. The same or similar reference indicators will be used throughout the drawings and the following detailed description to refer to the same or like parts.

In the interest of clarity, not all of the routine features of the implementations described herein are shown and described. It will, of course, be appreciated that in the development of any such actual implementations, numerous implementation-specific decisions must be made to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
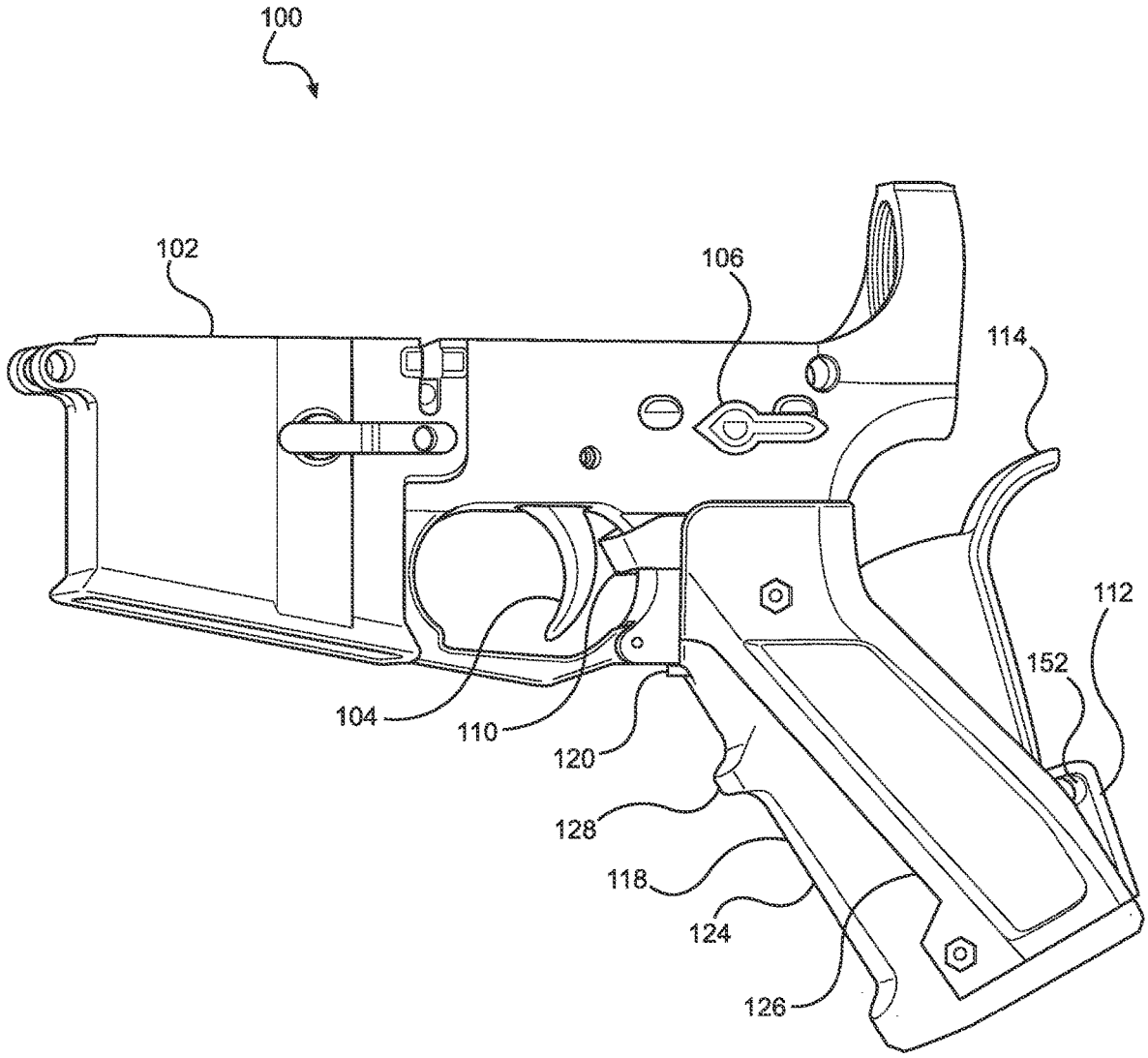
FIG. 1 is a side view of one embodiment of the adjustable trigger safety system.

Referring initially to FIG. 1, one embodiment of an adjustable trigger safety system 100 is shown. The adjustable trigger safety system 100 replaces the handle or grip of a firearm. For example, the adjustable trigger safety system 100 can replace the grip an AR-15 style rifle having a lower receiver 102, a trigger 104, and main safety 106. The adjustable trigger safety system 100 comprises a grip 124 and a finger actuator 110. The grip 124 houses several other components including a frame 118, a grip cover 126, and a finger rest 128. A safety lever 112 and an activation lever 114 are configured to rotate into and out of the interior of the grip 124. The grip 124 and other components of the adjustable trigger system 100 may be made of metal, metal alloys, fiberglass and resin, composite materials, rubber, plastic, or any material or combination of materials that allow that component to function as intended. The grip 124 can be configured in various shapes and sizes to accommodate any firearm, as well as the comfort of the user, including, but not limited to, left-handed operation. The adjustable trigger safety system 100 mounts to the lower receiver 102. It should be appreciated by one skilled in the art that the adjustable trigger safety system 100 can be adapted to any type of firearm that utilizes a removable grip.

In some embodiments of the present invention, an accessory connector 120 provides a portal for users to connect electrical devices, including, but not limited to, flashlights, target designators, and night optics. Upon release of the safety lever 112, the external device will de-energize.

The safety lever 112 and the activation lever 114 are positioned to promote proper hand grip and function to prevent accidental discharge of the firearm. When the adjustable trigger safety system 100 is engaged, the main safety 106 is prevented from rotating from the "Safe" position to the "Fire" position. When the adjustable trigger safety system 100 is disengaged by the user, the main safety 106 is permitted to rotate from the "Safe" position to the "Fire" position, thereby allowing the firearm to discharge.

To disengage the adjustable trigger safety system 100, the user must activate a finger actuator 110, which allows the main safety 106 to rotate. Next, the safety lever 112 must first be depressed until it is flush with the grip 124. This in turn allows the activation lever 114 to rotate into the grip 124 and cause the main safety 106 to rotate.

In some embodiments, the safety lever 112 has a locking hole 152, which allows for the use of a locking device (not shown) to prevent the safety lever 112 from being rotated into the grip 124, thereby maintaining the main safety 106 in the "Safe" position. In other embodiments, the locking hole 152 is located on the activation lever 114.

Figure 2:
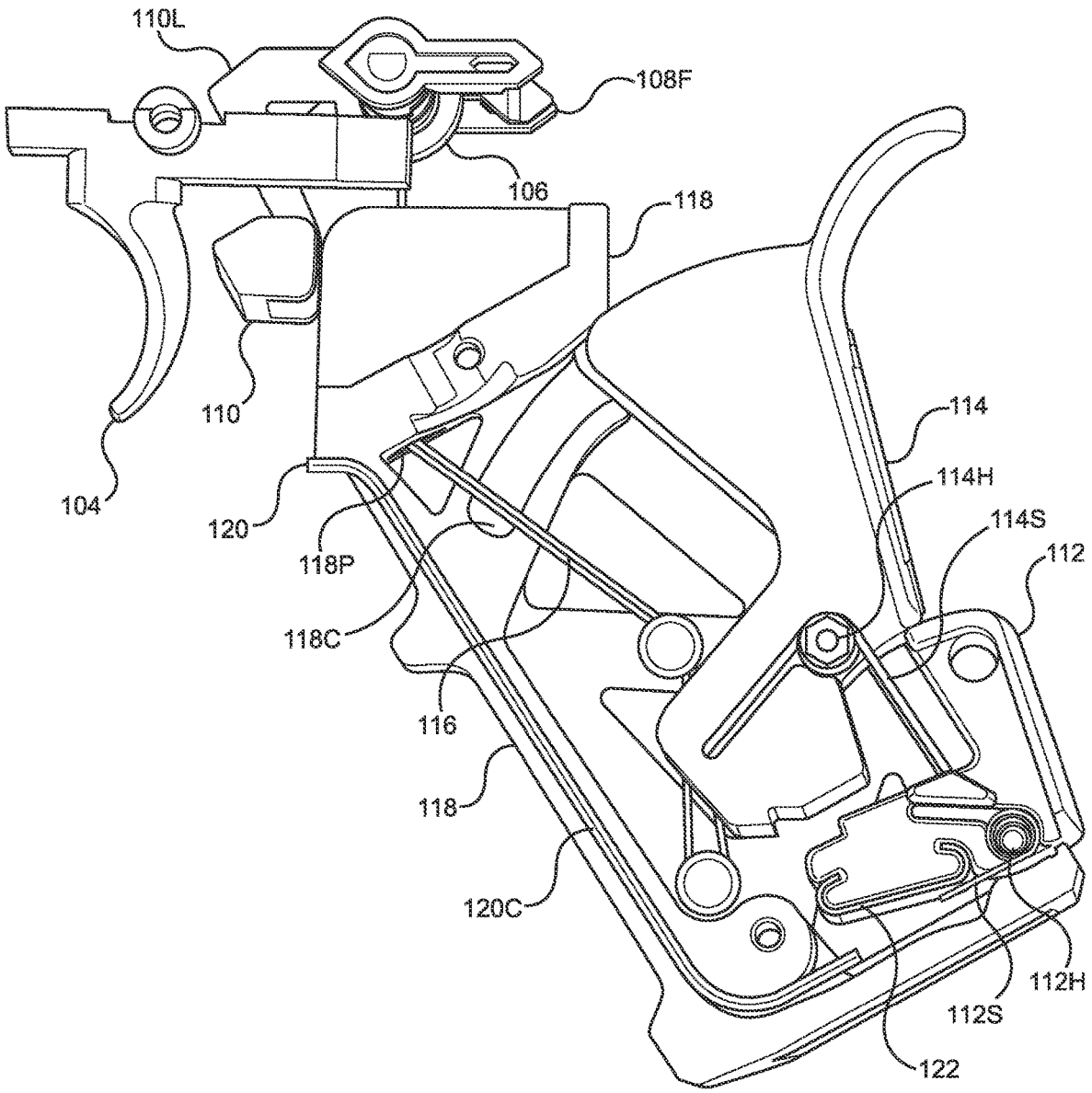
FIG. 2 is a side cutaway view of one embodiment of the adjustable trigger safety system of FIG. 1 to show an internal layout of the adjustable trigger safety system.

Referring to FIG. 2, a side cutaway view of one embodiment of the adjustable trigger safety system 100 is shown. A finger actuator lever 110L connects the finger actuator 110 to the trigger safety indicator 108F and a trigger safety gear 108G (see FIG. 10). The finger actuator 110 can be actuated from either side of the firearm. Located internal to the frame 118 are a safety cable 116, the accessory connector 120, an accessory connector channel 120C, an accessory activator 122, a safety lever hinge 112H, an activation lever hinge 114H, and a cable passage 118P. The safety cable 116 allows for the movement of the activation lever 114 to cause the main safety 106 to rotate, when allowed. As shown, the adjustable trigger safety system 100 is engaged; the main safety 106 is not allowed to rotate; and depressing the trigger 104 will not discharge the firearm.

The frame 118 is a structure used to contain the internal components of the adjustable trigger safety system 100 and to provide pivot points with some of the internal components. Some internal parts have pivot points that engage the frame 118, thereby allowing those parts to move, rotate, pivot, turn, or roll. The safety lever 112 and the activation lever 114 are mounted internally to the frame 118. When activated, the safety lever 112 rotates at hinge 112H. When rotated, the safety lever 112 allows for the activation lever 114 to rotate at the activation lever hinge 114H. A portion of the safety lever 112 and the activation lever 114 protrude from the frame 118, these portions being designed to engage a user's hand. When the user releases the safety lever 112, it is returned to its original position by a safety lever spring 112S. When the user releases the activation lever 114, it is returned to its original position by an activation lever spring 114S. Different springs 112S and 114S can be used to adjust the tension on the safety lever 112 and the activation lever 114, respectively.

A lever guide channel 118C provides a path for a cable catch 114C (see FIG. 4) to travel in when depressing the activation lever 114. When the activation lever 114 is depressed to a certain point, the cable catch 114C makes contact with the safety cable 116. As the activation lever 114 is further depressed, a force is applied to the safety cable 116 by the cable catch 114C. The safety cable 116 transfers that force to the main safety 106 causing it to rotate.

Figure 3:
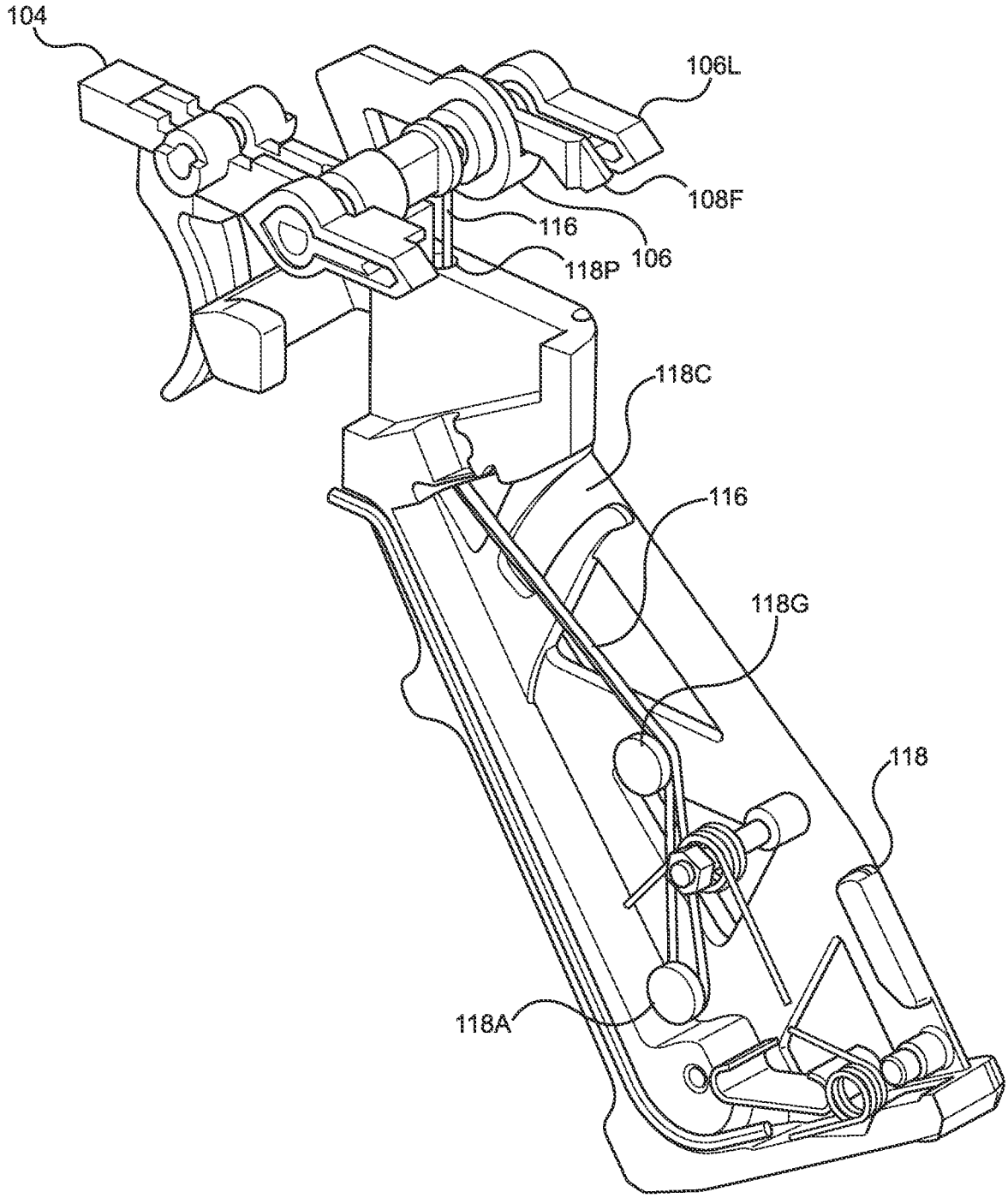
FIG. 3 is a side perspective cutaway view of one embodiment of the adjustable trigger safety system to show internal components when the adjustable trigger safety system is in safe mode.

Referring to FIG. 3, shown is a side perspective cutaway view of one embodiment of the adjustable trigger safety system 100 showing the internal components when the adjustable trigger safety system 100 is engaged. The trigger 104 is prevented by the main safety 106 from being pressed. In this condition, the trigger safety indicator 108F is lined up with a main safety lever 106L indicating that the adjustable trigger safety system 100 is engaged. The tightness and the type of the safety cable 116 can be adjusted to change the operating characteristics of the activation lever 114. In some embodiments, the safety cable 116 is anchored to the frame 118 at a frame anchor 118A and passes through a cable guide 118G. In some embodiments, the cable guide 118G is adjustable to adjust the operating characteristics of the activation lever 114. In other embodiments, the safety cable 116 attaches to the cable guide 118G. The cable guide 118G can be rotated to adjust the tension of the safety cable 116. In additional embodiments, the cable guide 118G can be adjusted from the exterior of the frame 118 where a tool can be used to make the adjustments.

The safety cable 116 passes through a cable passage 118P located in the frame 118. The safety cable 116 then connects to the main safety 106 such that when the adjustable trigger safety system 100 is disengaged, the safety cable 116 causes the main safety 106 to rotate from the "Safe" position to the "Fire" position. Also shown is a guide channel 118G located integral to the frame 118. The cable passage 118P provides a pathway for the safety cable 116 to exit the interior of the frame 118 in an upward direction to allow it to interface with the main safety 106. The edges of the cable passage 118P are polished to minimize friction with and wear to the safety cable 116. Additionally, the lever guide channel 118C is shown.

Figure 4:
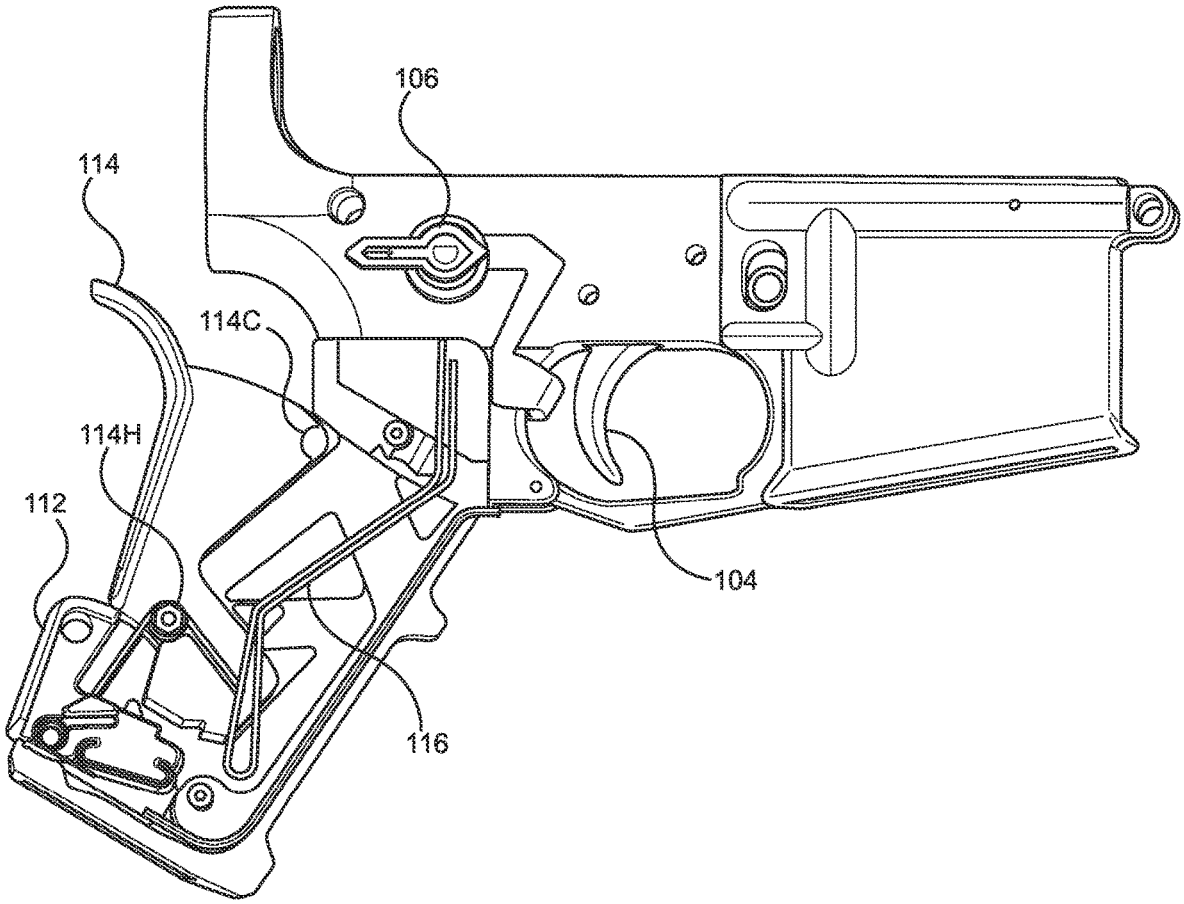
FIG. 4 is a partial side cutaway view of the one embodiment of the adjustable trigger safety system of FIG. 1 to allow for additional visibility to internal components.

Referring to FIG. 4, a side partial cutaway view of one embodiment of the adjustable trigger safety system 100 is shown. Shown is the cable catch 114C located on the activation lever 114. The safety lever 112 must be depressed prior to depressing the activation lever 114. When the activation lever 114 is depressed and rotates at the activation lever hinge 114H into the frame 118 (see FIG. 3), the cable catch 114C moves along the cable guide 118G (see FIG. 3) until it comes in contact with the safety cable 116. As the activation lever 114 is rotated further, it applies a force to the safety cable 116. Since the safety cable 116 is anchored at one end at the frame anchor 118A (see FIG. 3), the tension added to the safety cable 116 by the cable catch 114C causes the main safety 106 to rotate, which allows the trigger 104 to be pressed and the firearm discharges. It should be noted that the safety lever 112 can be released after the activation lever 114 is fully depressed.

Figure 5:
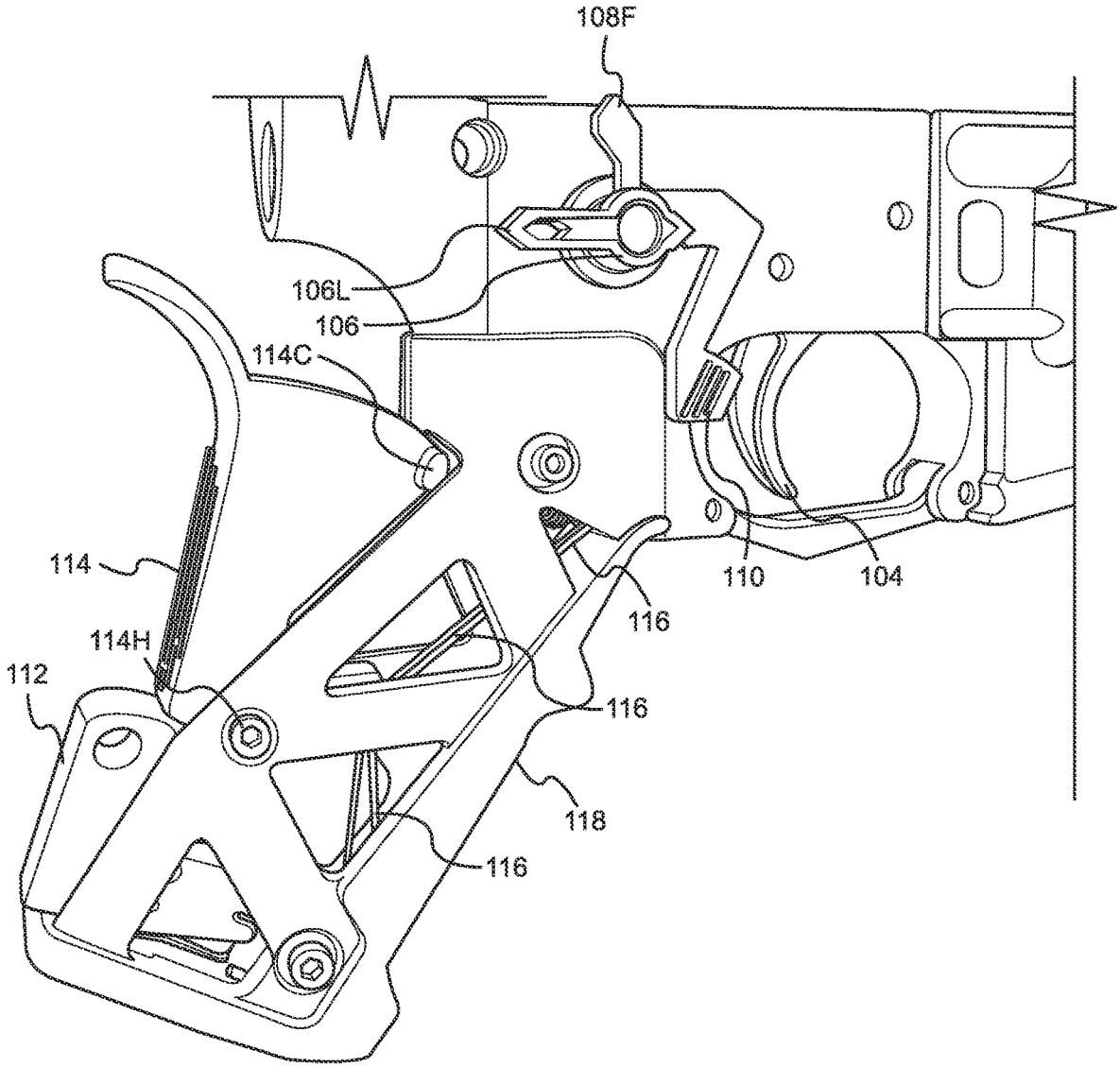
FIG. 5 is a side perspective showing some internal components of one embodiment when the adjustable trigger safety system is engaged.

Referring to FIG. 5, a side view is shown having some external components removed for clarity. The activation lever hinge 114H is shown connected to the frame 118. As shown, the trigger safety indicator 108F is in a vertical position while the main safety lever 106L is in the horizontal position, meaning that the finger actuator 110 has been actuated. When the finger actuator 110 is actuated, the trigger safety indicator 108F automatically rotates from the horizontal position to the vertical position. As will be described further below, when the safety lever 112 and the activation lever 114 are fully rotated into the frame 118, the main safety 106 will rotate and the trigger 104 is free to be pulled. Also shown is the cable catch 114C and the safety cable 116. The positioning of the safety cable 116 should be noted since its positioning will change when the activation lever 114 is depressed and the cable catch 114C comes into contact with and applies a force to the safety cable 116.

Figure 6:
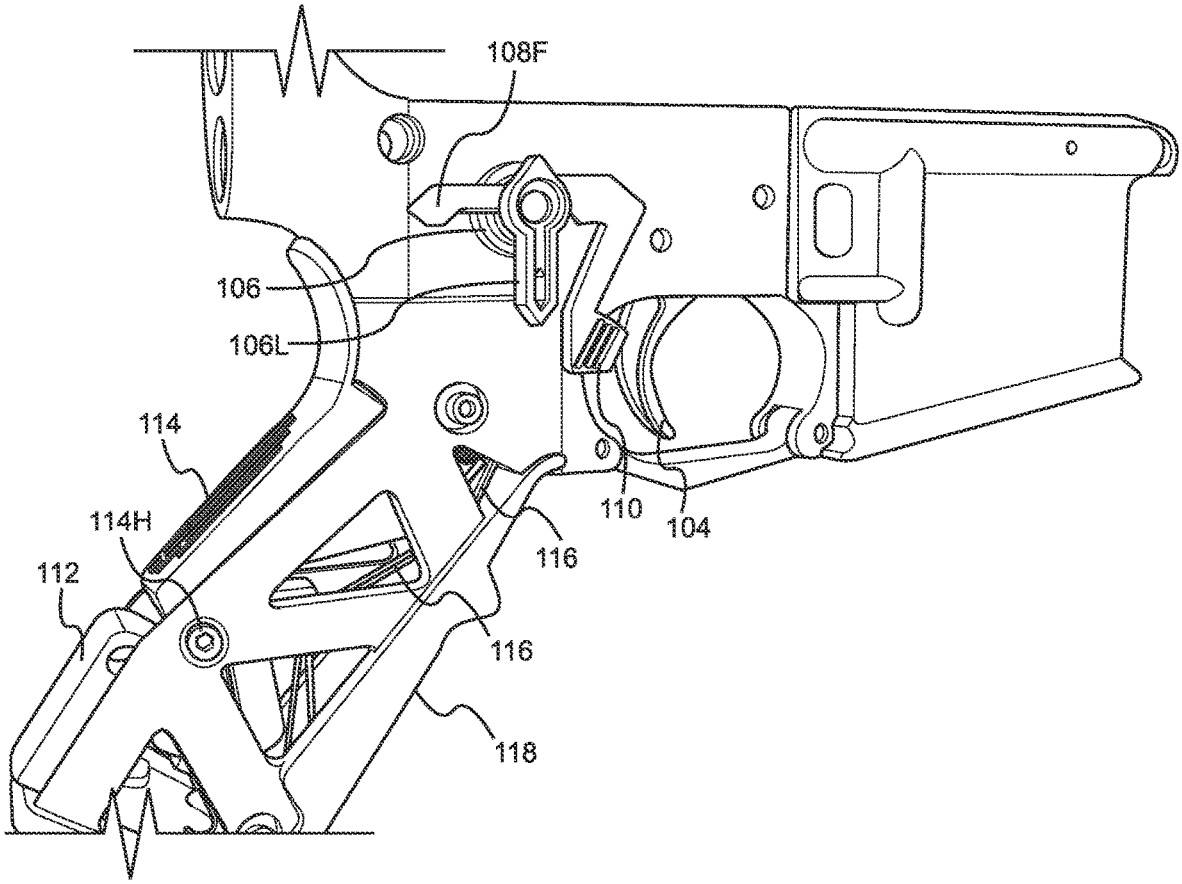
FIG. 6 is a side view of the one embodiment of the adjustable trigger safety system with external components removed for clarity to show internal components when the adjustable trigger safety system is disengaged and the main safety is in the "Fire" position.

Referring to FIG. 6, a side view of the one embodiment of the adjustable trigger safety system 100 is shown with some external components removed for clarity. As shown, the adjustable trigger safety system 100 is disengaged and the trigger 104 can be pulled. The safety lever 112 and the activation lever 114 have been fully rotated into the frame 118. The trigger safety indicator 108F is exposed from behind the main safety lever 106L indicating that the finger actuator 110 has been actuated. The main safety lever 106L is now pointing in a downward vertical direction indicating that the main safety 106 is in the "Fire" position and the trigger 104 can be pulled to discharge the firearm. When the activation lever 114 was fully rotated into the frame 118, the cable catch 114C (see FIG. 5) contacts the safety cable 116, applying a force thereto. The safety cable 116 is designed to not stretch, thereby transferring that force to the main safety 106 causing it to rotate. In this condition, the trigger 104 can be pulled and the firearm will discharge. In some embodiments, the main safety 106 will stay in the "Fire" position even after the activation lever 114 is released and returns to its original position. In these embodiments, the main safety 106 can be returned to the "Safe" position manually by the user. In other embodiments, the adjustable trigger safety system 100 can return the main safety 106 to the "Safe" position when the activation lever 114 is released and it returns to its original position. Also shown is the activation lever hinge 114H integral to the frame 118.

Figure 7:
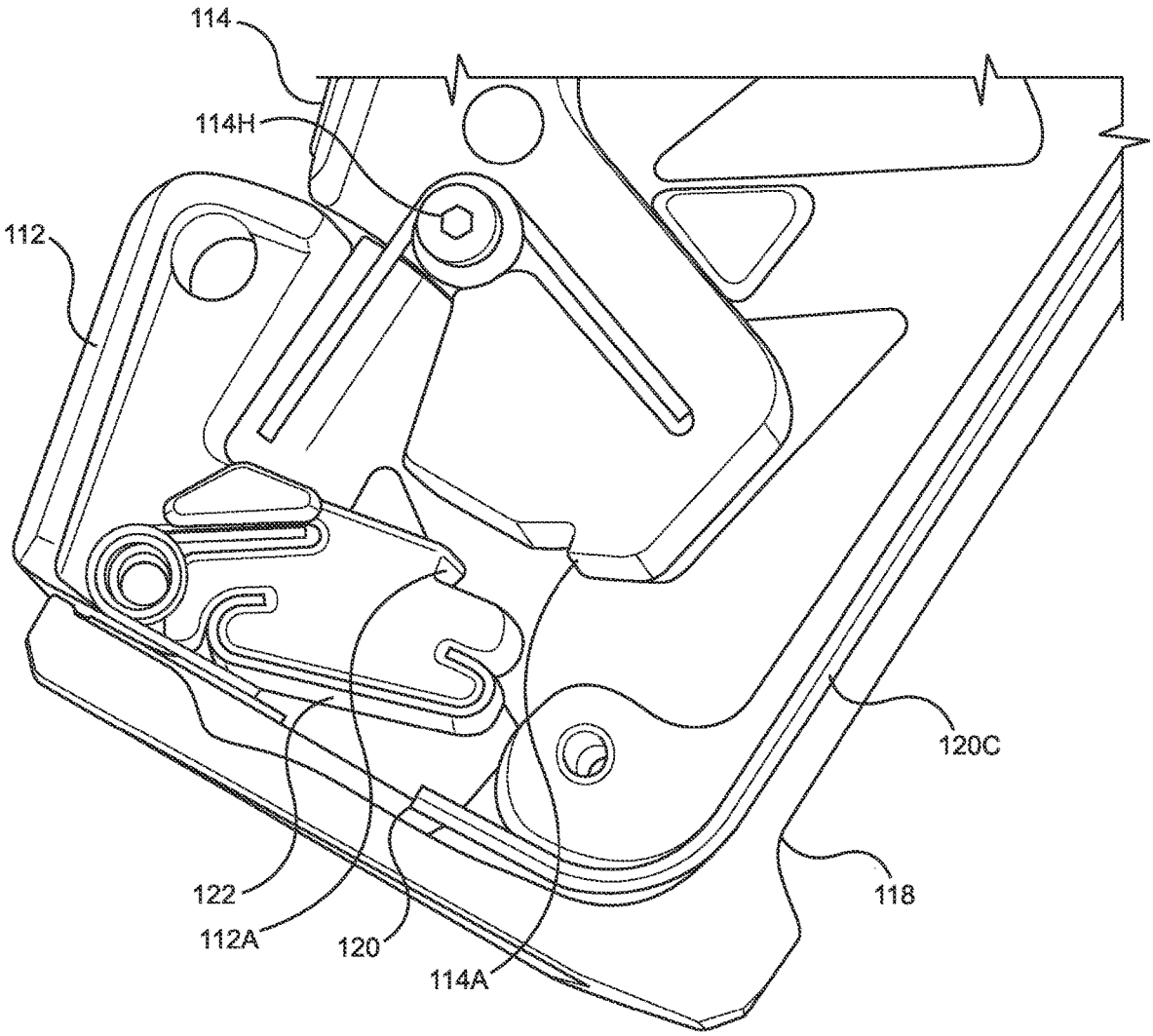
FIG. 7 is a close-up side cutaway view of one embodiment of the adjustable trigger safety system to show the interaction between the safety lever and the activation lever.

Referring to FIG. 7, a close-up, side cutaway view of one embodiment of the adjustable trigger safety system 100 is shown. The safety lever 112 has a safety lever catch 112A, and the activation lever 114 has a corresponding activation lever catch 114A. If the safety lever 112 is not depressed before the activation lever 114, the activation lever catch 114A will come in contact with the safety lever catch 112A, thereby preventing the activation lever 114 from rotating enough around the activation lever hinge 114H such that the cable catch 114C (see FIG. 5) does not come into contact with the safety cable 116 (see FIG. 6).

When the safety lever 112 is depressed first, followed by the activation lever 114, the safety lever catch 112A moves such that it will no longer come into contact with the activation lever catch 114A as the activation lever 114 is depressed. In some embodiments, the safety lever 112 does not need to be fully depressed to allow the activation lever 114 to be depressed such that the cable catch 114C comes into contact with the safety cable 116 (see FIG. 5).

The accessory activator 122 allows for the activation of an external device, such as a laser, an indicator, a flashlight, or any device configured to be used with a firearm. In operation, when the safety lever 112 is depressed, the accessory activator 122 comes in contact with the accessory connector 120, thereby activating any connected external device. In some embodiments, the accessory connector 120 is routed through the frame 118 using an accessory connector channel 120C. The accessory connector 120 can be located anywhere in the frame 118 where it can be accessed from the exterior of the frame 118. It should be noted that after the activation lever 114 is depressed, the safety lever 112 can be released. This also allows for a user to use the safety lever 112 to control the external device after the adjustable trigger safety system 100 is disengaged. In some embodiments, the safety lever 112 needs to be fully depressed to activate the external device to allow for the disengagement of the adjustable trigger safety system 100 without activating the external device.

Figure 8:
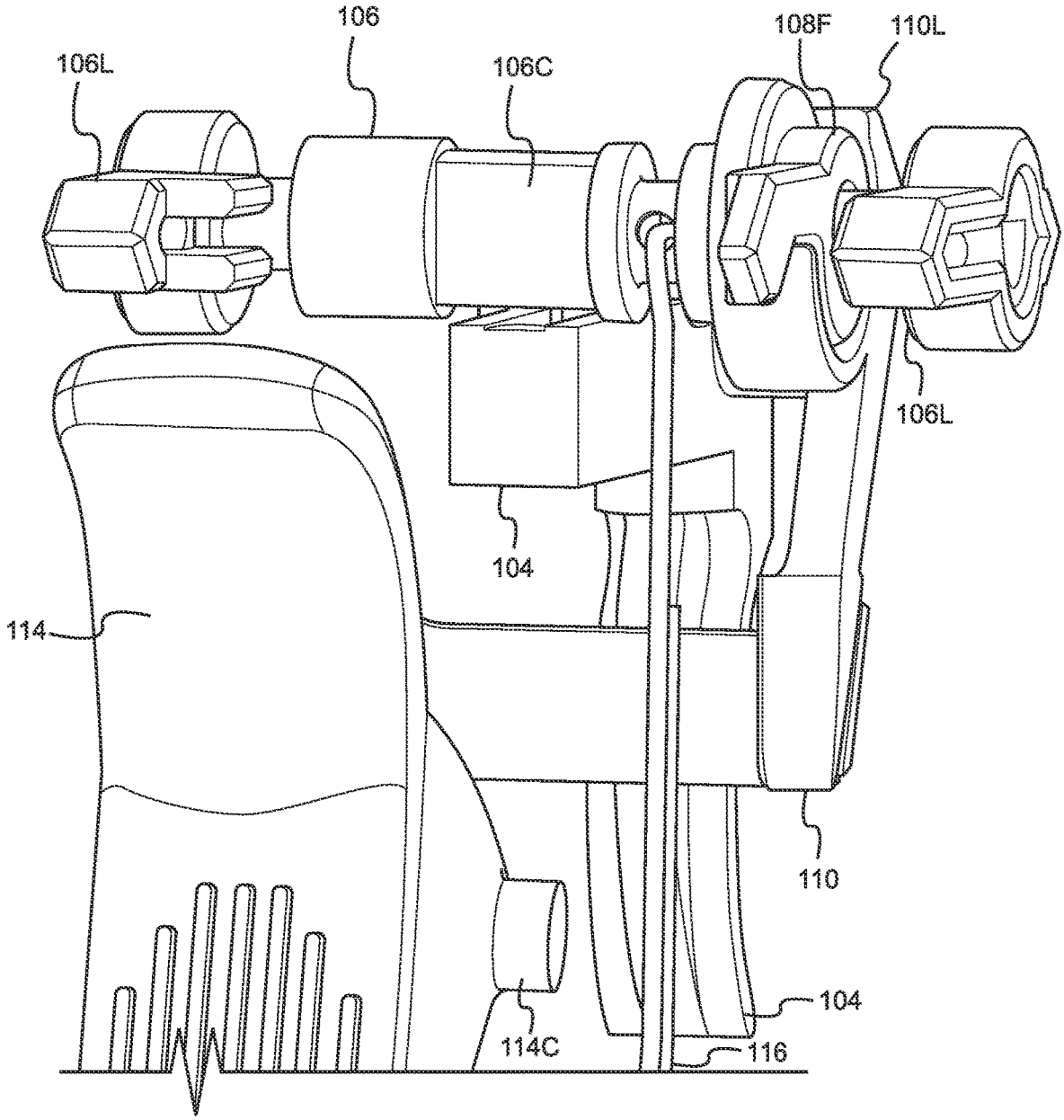
FIG. 8 is a rear perspective view of one embodiment of the adjustable trigger safety system showing the safety cable engaged with the main safety when the adjustable trigger safety system is engaged.

FIG. 8 is a rear perspective, close-up view of the main safety 106 and components that are related to it. As shown, the activation lever 114 is not depressed and the main safety 106 is in the "Safe" position as indicated by the horizontal orientation of the main safety levers 106L. In this position, a main safety cylinder 106C prevents the trigger 104 from rotating up when depressed, thereby the firearm cannot be discharged. The trigger safety indicator 108F is also in the horizontal position, meaning that the finger actuator 110 has not been actuated. In this condition, disengaging the adjustable trigger safety system 100 will not result in the main safety 106 rotating to the "Fire" position. As will be described below, the trigger safety indicator 108F is mechanically locked to the main safety 106. With the trigger safety indictor 108F in the horizontal position, the finger actuator lever 110L prevents the trigger safety indicator 108F from rotating down to the vertical position, which thereby prevents the main safety 106 from rotating down to the "Fire" position. As shown in FIG. 8, the finger actuator lever 110L only allows the trigger safety indicator 108F to rotate between the horizontal rearward position and the vertically up position. For the main safety 106 to rotate to the "Fire" position, the trigger safety indicator 108F must first be moved to the vertically up position, thereby allowing the trigger safety indicator 108F to rotate back to the horizontally rearward position when the activation lever 114 is depressed. Any additional rotation is prevented by the finger actuator lever 110L.

The safety cable 116 connects to the main safety 106 such that a downward force on the safety cable 116 causes the main safety 106 to rotate. It should be noted that when the main safety 106 rotates to the "Fire" position and the main safety lever 106L is vertically pointing down, the main safety cylinder 106C also rotates such that it no longer prevents the trigger 104 from being depressed and discharging the firearm. Also shown is the cable catch 114C.

Figure 9:
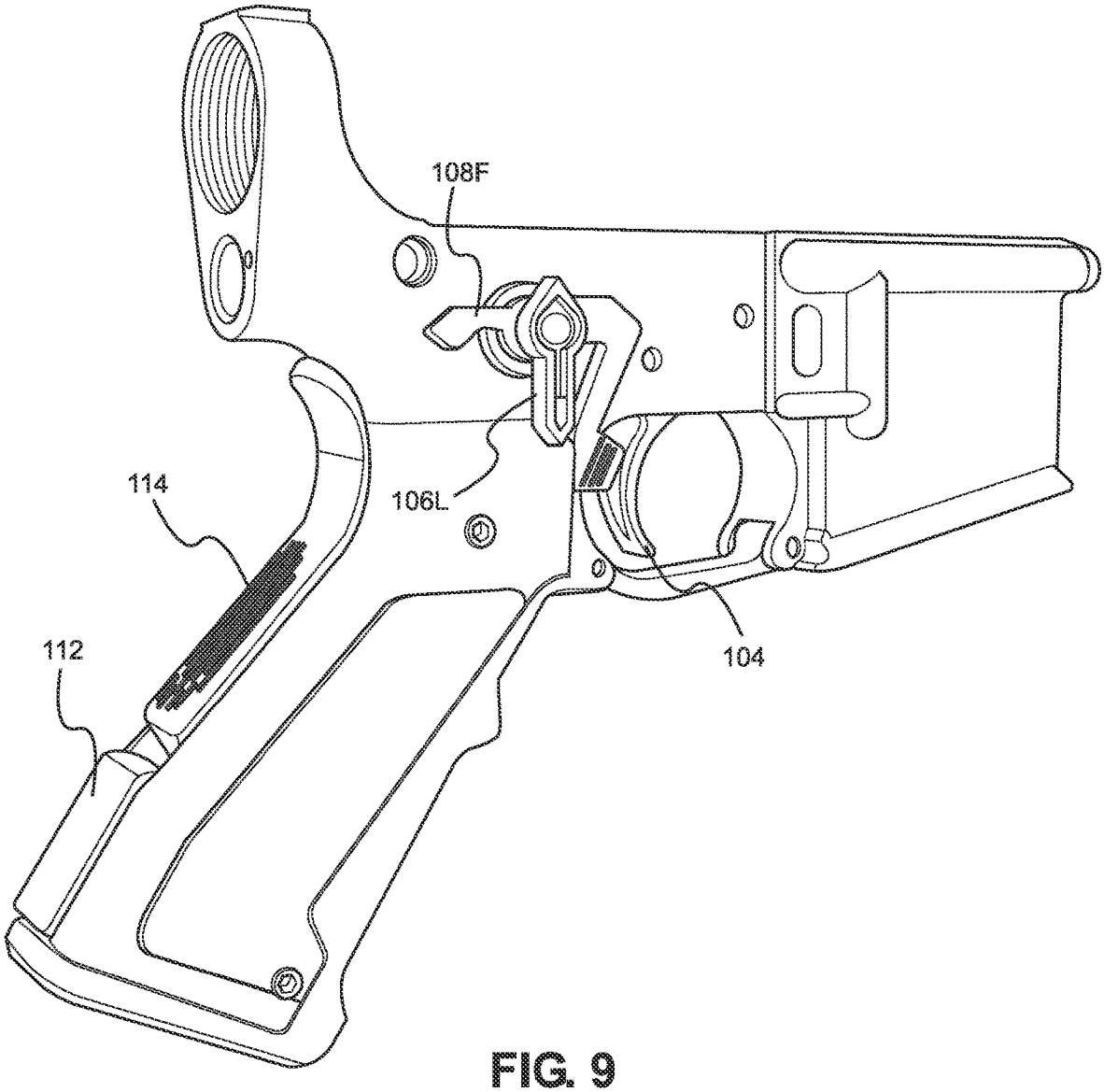
FIG. 9 is a side perspective view of one embodiment of the adjustable trigger safety system showing the adjustable trigger safety system in the "Fire" position.

Referring to FIG. 9, a side perspective view showing the firearm in the "Fire" condition as evidenced, in part, by the main safety lever 106L pointing in the downward direction. The safety lever 112 and the activation lever 114 have been depressed and the trigger safety indicator 108F is pointing horizontally rearward indicating that the adjustable trigger safety system 100 is disengaged and the firearm will fire if the trigger 104 is depressed.

Figure 10:
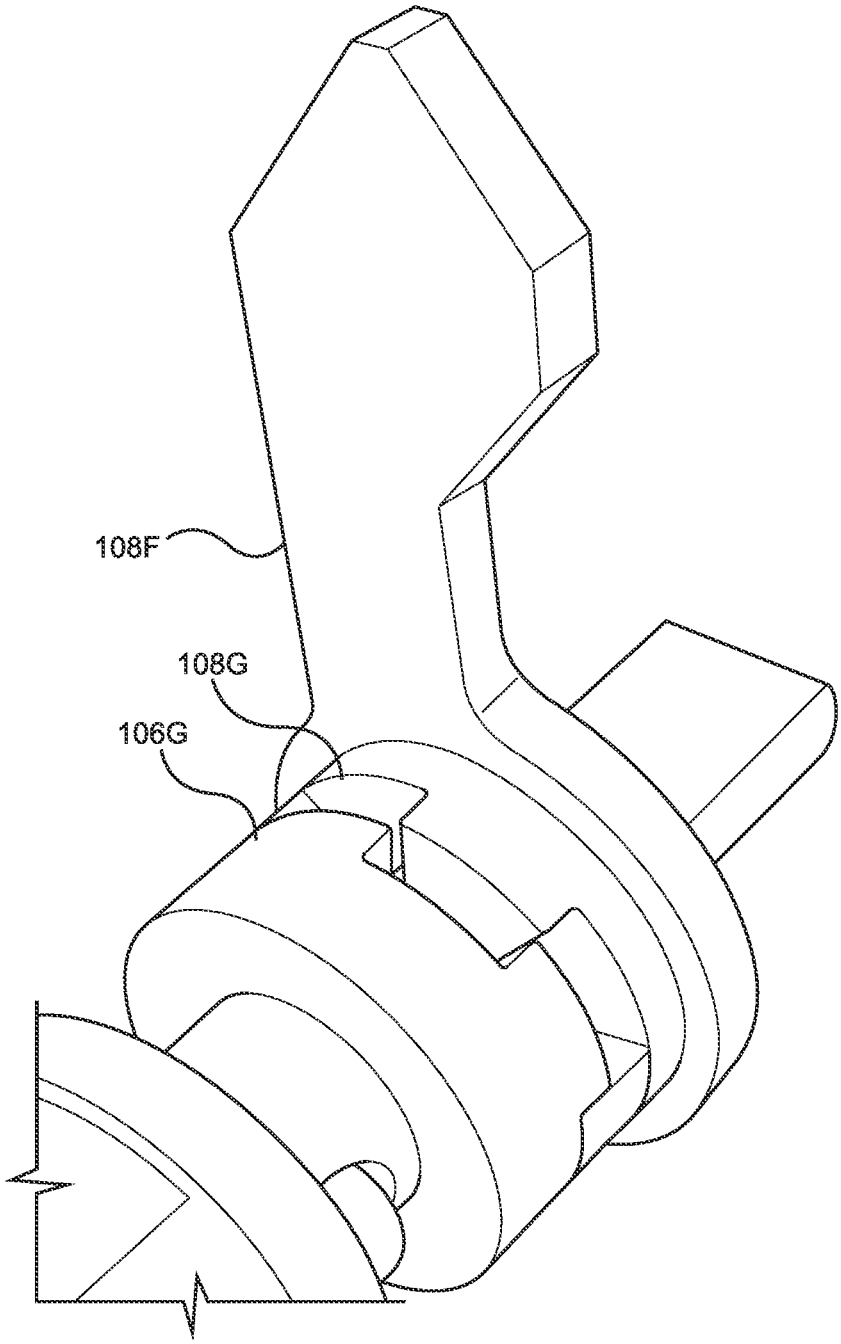
FIG. 10 is a close-up perspective view of the trigger safety indicator and the main safety when disengaged.

Referring to FIG. 10, a close-up perspective view of the trigger safety indicator 108F disengaged from the main safety 106 (see FIG. 8), thereby allowing the trigger safety indicator 108F to rotate independent of the main safety 106.

The trigger safety indicator 108F has a trigger safety gear 108G configured to mechanically interact with a main safety gear 106G on the main safety 106. As will be explained below, the finger actuator 110 (see FIG. 8) causes the trigger safety gear 108G to disengage from the main safety gear 106G, thereby allowing the trigger safety indicator 108F to rotate.

In some embodiments, the trigger safety indicator 108F automatically rotates when the finger actuator 110 is actuated, such as, for example, by way of a spring force applied to the trigger safety indicator 108F. In other embodiments, the trigger safety indicator 108F stays in the rearward horizontal position when the adjustable trigger safety system 100 is re-engaged. In additional embodiments, the trigger safety indicator 108F will rotate back to the vertically up position when the main safety 106 rotates back to the "Safe" position and must be manually reset to the horizontally rearward position to prevent the main safety 106 from rotating to the "Fire" position.

Figure 11:
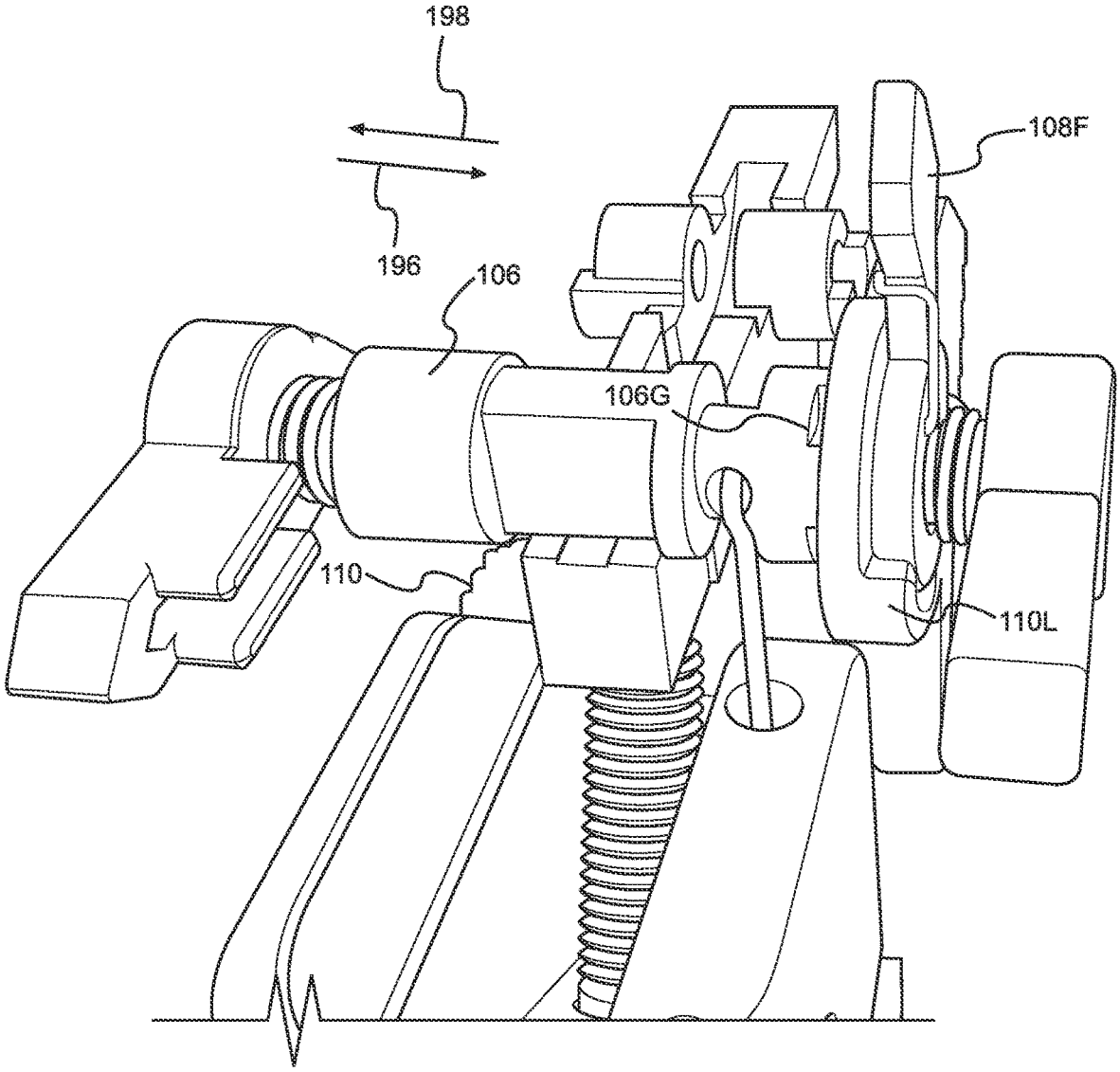
FIG. 11 is a rear perspective view of one embodiment of the adjustable trigger safety system showing the finger actuator moved in a direction to disengage the trigger safety indicator from the main safety.

Referring now to FIG. 11, a rear perspective view of one embodiment of the adjustable trigger safety system 100 showing the finger actuator 110 being actuated in a first direction 196. Movement in that first direction 196 causes the finger actuator lever 110L to move the trigger safety gear 108G such that the trigger safety gear 108G disengages from the main safety gear 106G, thereby allowing the trigger safety indicator 108F to rotate to the vertically up position. Due to the construction of the finger actuator lever 110L, the trigger safety indicator 108F cannot rotate past the vertically up position. Additionally, the construction of the finger actuator lever 110L prevents the trigger safety indicator 108F from rotating past the horizontally rearward position. This means that before the main safety 106 is rotated from the "Safe" position to the "Fire" position, the finger actuator 110 must be actuated to allow for the trigger safety indicator 108F to reposition to the vertically up position independent of the rotation of the main safety 106. When the finger actuator 110 is released, it moves in the second direction 198, the finger actuator lever 110L returns to its original position, and the trigger safety gear 108G (not shown) re-engages with the main safety gear 106G. In this condition, when the activation lever 114 is depressed, the main safety 106 will be able to rotate to the "Fire" position.

Figure 12:
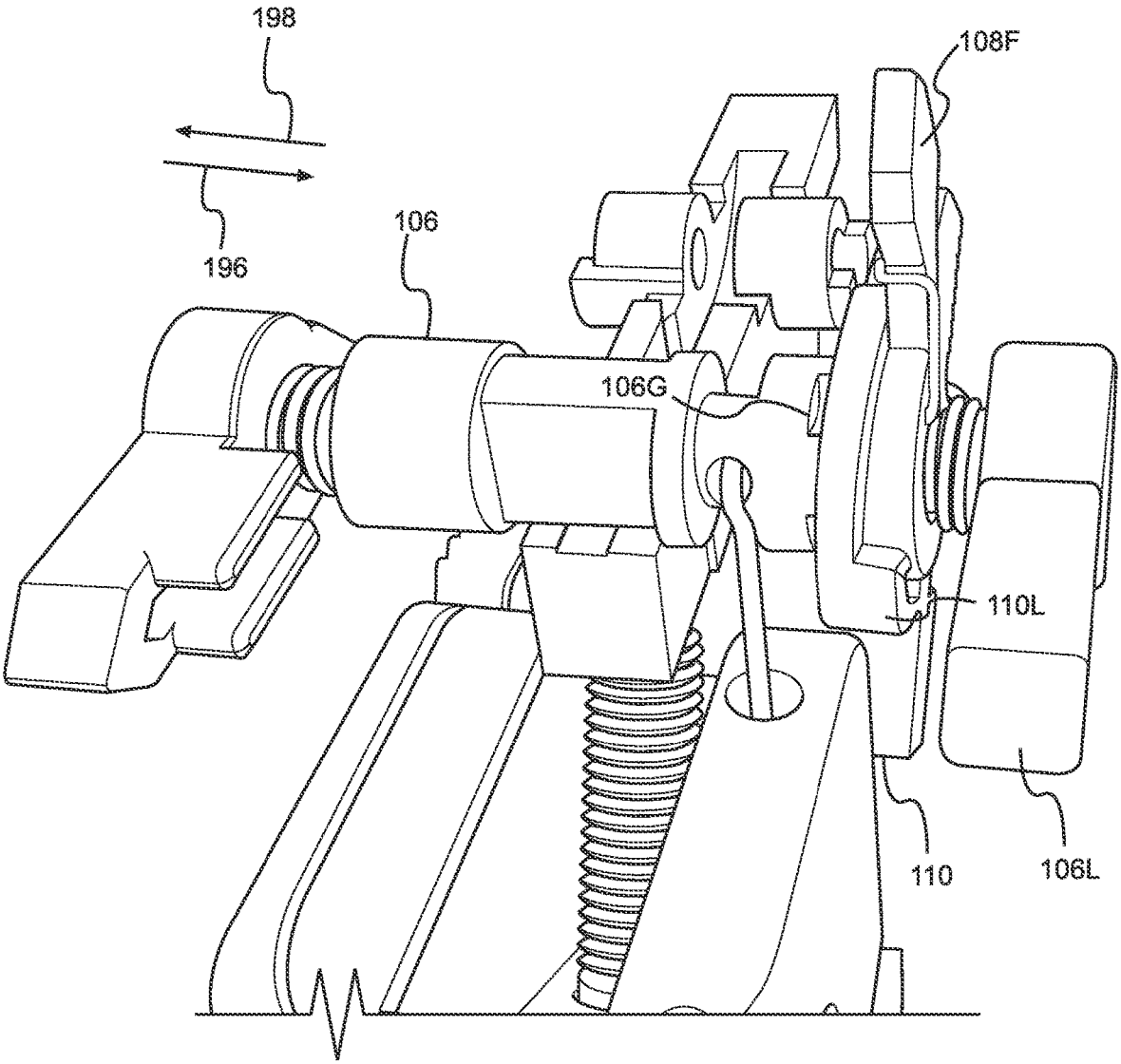
FIG. 12 is a rear perspective view of one embodiment of the adjustable trigger safety system showing the finger actuator moved in a direction to disengage the trigger safety indicator from the main safety.

Referring to FIG. 12, a rear perspective view of one embodiment of the adjustable trigger safety system 100 showing the finger actuator 110 moved in a second direction 198. Movement in the second direction 198 causes the finger actuator lever 110L to tilt out toward the main safety lever 106L, thereby disengaging the main safety gear 106G and the trigger safety gear 108G (not shown). This allows for the trigger safety indicator 108F to rotate to the vertically up position independent of the rotation of the main safety 106. When released, the finger actuator 110 moves in the first direction 196, the finger actuator lever 110L returns to its original position, and the trigger safety gear 108G (not shown) re-engages with the main safety gear 106G.

The embodiments described herein are not intended to be exhaustive or to limit the invention to the precise forms disclosed in the detailed description. Rather, the embodiments are chosen and described so that others skilled in the art can appreciate and understand the principles and practices. As such, aspects have been described with reference to various embodiments and techniques. However, it should be understood that many variations and modifications may be made while remaining within the spirit and scope herein.

It is understood that although a number of different embodiments of the adjustable trigger safety system have been illustrated and described herein, one or more features of any one embodiment can be combined with one or more features of one or more of the other embodiments, provided that such combination satisfies the intent of the adjustable trigger safety system.

While a number of exemplary aspects and embodiments of the adjustable trigger safety system have been discussed above, those of skill in the art will recognize certain modifications, permutations, additions, and sub-combinations thereof. It is therefore intended that the following appended claim and claims hereafter introduced are interpreted to include all such modifications, permutations, additions, and sub-combinations as are within their true spirit and scope.

What is claimed is:

1. An adjustable trigger safety system comprising:

a frame configured to mount to a firearm proximate to a trigger;

a safety lever partially extending from the frame;

an activation lever partially extending from the frame; and a main safety configured to move between a first position and a second position; and wherein the safety lever must be depressed before the activation lever can be depressed, and wherein when the activation lever is depressed, it causes the main safety to move from the first position to the second position.

2. The adjustable trigger safety system of claim 1 further comprising:

a first safety catch on the safety lever;

a second safety catch on the activation lever that corresponds to the first safety catch, wherein the first safety catch will intersect with the second safety catch to prevent the activation lever from being depressed if the safety lever is not at least partially depressed before the activation lever is depressed.

3. The adjustable trigger safety system of claim 1 further comprising:

a safety cable anchored at one end to the interior of the frame and attached to the main safety at the other end, wherein when the activation lever is depressed, the activation lever will come into contact with and apply a force to the safety cable, which will transfer the force to the main safety causing it to move from the first position to the second position.

4. The adjustable trigger safety system of claim 1 further comprising a cable catch located on the activation lever and configured to come into contact with and apply a force to the safety cable when the activation lever is depressed.

5. The adjustable trigger safety system of claim 1 further comprising a locking hole located on the safety lever and configured to receive a locking device, where the locking device will prevent the safety lever from being depressed.

6. The adjustable trigger safety system of claim 1 further comprising:

an accessory connector configured to connect to a device; and an accessory activator configured to activate the device, wherein the device can be located external to the frame.

7. The adjustable trigger safety system of claim 6, wherein the accessory activator is integral to the safety lever, and wherein the accessory activator will activate the device when the safety lever is depressed.

8. The adjustable trigger safety system of claim 7, wherein the safety lever must be fully depressed for the accessory activator to activate the device.

9. The adjustable trigger safety system of claim 1, wherein the activation lever causes the main safety to return to its original position when the activation lever returns to its original position.

10. An adjustable trigger safety system comprising:

a firearm having a main safety and a grip;

an activation lever located partially in the grip and configured to cause the main safety to move from a safe position to a fire position;

a trigger safety indicator mechanically engaged with the main safety and capable of rotating from a first position to a second position independent of the main safety; and a finger actuator configured to mechanically disengage the trigger safety indicator from the main safety, wherein the finger actuator must be actuated so that the trigger safety indicator rotates to the second position while the main safety stays in the safe position before the activation lever can be depressed causing the main safety to move from the safe position to the fire position.

11. The adjustable trigger safety system of claim 10, wherein the trigger safety indicator automatically moves from the first position to the second position when the finger actuator is actuated.

12. The adjustable trigger safety system of claim 10, wherein when the activation lever is released, the main safety returns to the safe position.

* * * * *